US009728902B2

(12) United States Patent
Höher et al.

(10) Patent No.: US 9,728,902 B2
(45) Date of Patent: Aug. 8, 2017

(54) PLUG CONNECTOR

(71) Applicant: ROSENBERGER HOCHFREQUENZTECHNIK GMBH & CO. KG, Fridolfing (DE)

(72) Inventors: Tobias-Lars Höher, Waging am See (DE); Tobias Stadler, Fridolfing (DE); Thomas Müller, Berchtesgaden (DE)

(73) Assignee: Rosenberger Hochfrequeńztechnik GmbH & Co. KG, Fridolfing (DE)

( * ) Notice: Subject to any disclaimer, the term of this patent is extended or adjusted under 35 U.S.C. 154(b) by 58 days.

(21) Appl. No.: 14/428,152

(22) PCT Filed: Aug. 7, 2013

(86) PCT No.: PCT/EP2013/002358
§ 371 (c)(1),
(2) Date: Mar. 13, 2015

(87) PCT Pub. No.: WO2014/044337
PCT Pub. Date: Mar. 27, 2014

(65) Prior Publication Data

US 2015/0270647 A1 Sep. 24, 2015

(30) Foreign Application Priority Data

Sep. 18, 2012 (DE) ..... 20 2012 008 970 U

(51) Int. Cl.
*H01R 13/6585* (2011.01)
*H01R 9/03* (2006.01)
(Continued)

(52) U.S. Cl.
CPC ..... *H01R 13/6585* (2013.01); *H01R 9/035* (2013.01); *H01R 9/038* (2013.01);
(Continued)

(58) Field of Classification Search
CPC ..... H01R 9/035; H01R 9/038; H01R 13/514; H01R 13/658; H01R 13/6461;
(Continued)

(56) References Cited

U.S. PATENT DOCUMENTS 4,974,075 A * 11/1990 Nakajima ..... A61B 1/00124 348/75
5,037,314 A * 8/1991 Bricaud ..... H01R 13/426 439/78
(Continued)

FOREIGN PATENT DOCUMENTS

CN 1482713 A 3/2004
DE 20 2006 019107 U1 2/2007
(Continued)

*Primary Examiner* — Tulsidas C Patel
*Assistant Examiner* — Travis Chambers
(74) *Attorney, Agent, or Firm* — DeLio, Peterson & Curcio, LLC; Robert Curcio

(57) ABSTRACT

A plug connector having a housing and at least four contact elements arranged within the housing to transmit high-frequency signals, wherein two contact elements respectively form a contact element pair, each of which is integrated into an insulating body. In that arrangement, the insulating bodies are each surrounded by a shield.

22 Claims, 7 Drawing Sheets

(51) Int. Cl.

| | |
|---|---|
| ***H01R 13/6582*** | (2011.01) |
| ***H01R 13/6592*** | (2011.01) |
| ***H01R 13/6593*** | (2011.01) |
| ***H01R 24/56*** | (2011.01) |
| ***H01R 24/86*** | (2011.01) |
| ***H01R 13/6461*** | (2011.01) |
| *H01R 107/00* | (2006.01) |

(52) U.S. Cl.
CPC ..... *H01R 13/6461* (2013.01); *H01R 13/6582* (2013.01); *H01R 13/6592* (2013.01); *H01R 13/6593* (2013.01); *H01R 24/568* (2013.01); *H01R 24/86* (2013.01); *H01R 2107/00* (2013.01)

(58) Field of Classification Search
CPC ..... H01R 13/6582; H01R 13/6585; H01R 13/6592; H01R 13/6593; H01R 24/86; H01R 24/568; H01R 2107/00
USPC ..... 439/607.05, 607.08, 701, 607.06
See application file for complete search history.

(56) References Cited

U.S. PATENT DOCUMENTS

| | | | | |
|---|---|---|---|---|
| 5,244,415 | A | 9/1993 | Marsilio | |
| 5,766,040 | A | 6/1998 | Naerland | |
| 5,876,248 | A * | 3/1999 | Brunker | H01R 23/688 439/607.08 |
| 6,244,892 | B1 * | 6/2001 | McCarthy | H01R 4/5025 439/421 |
| 6,494,743 | B1 * | 12/2002 | Lamatsch | H01R 23/688 439/607.05 |
| 6,935,881 | B2 * | 8/2005 | Kainz | B61G 5/10 439/135 |
| 7,195,518 | B2 * | 3/2007 | Bert | H01R 4/2441 439/290 |
| 7,740,501 | B2 * | 6/2010 | Ballard | H01B 9/003 174/105 R |
| 9,257,796 | B1 * | 2/2016 | Dang | H01R 9/035 |
| 9,306,312 | B2 * | 4/2016 | Dang | H01R 13/502 |
| 2007/0259568 | A1 | 11/2007 | Mackillop | |
| 2009/0011639 | A1 | 1/2009 | Ballard | |

FOREIGN PATENT DOCUMENTS

| | | | |
|---|---|---|---|
| DE | 102009021594 | A1 | 10/2010 |
| DE | 102010011370 | B3 | 4/2011 |
| EP | 0562691 | A1 | 9/1993 |
| EP | 2355258 | A1 | 8/2011 |
| EP | 2362492 | A1 | 8/2011 |
| FR | 2921522 | A1 | 3/2009 |
| JP | 5024473 | B1 | 9/2012 |

* cited by examiner

PLUG CONNECTOR

BACKGROUND OF THE INVENTION

1. Field of the Invention

The invention relates to a plug connector and in particular a plug connector which makes possible a transmission of high frequency signals with a data rate >10 Gbits and a bandwidth >500 MHz.

2. Description of Related Art

Plug connectors which are designed for the connection of twisted-pair cables with four wire pairs are known from the standard IEC 61076-2-109. For this purpose, the ends of the total of eight wires of the twisted-pair cables are each connected to a contact element. The eight contact elements are integrated in an insulator of the associated plug connector. The insulator forms four individual insulating segments which each accommodate two contact elements—a contact element pair. The contact element pairs are each connected with the ends of a wire pair of the twisted-pair cable. The insulator is enclosed by a metallic housing which serves as a shield for the contact elements arranged therein and also has fixing means in the form of a thread, a bayonet closure or a snap mechanism by means of which the two complementary plug connectors can be connected to form a plug connection.

The known plug connectors complying with IEC 61076-2-109 are suitable for the transmission of high frequency signals up to a data rate of approximately 10 Gbits and a bandwidth of approximately 500 MHz.

SUMMARY OF THE INVENTION

Bearing in mind the problems and deficiencies of the prior art, it is therefore an object of the present invention to provide an improved plug connector which is, in particular, suitable for the transmission of high frequency signals with a data rate greater than 10 Gbits and a bandwidth greater than 500 MHz.

It is another object of the present invention to improve the transmission properties of a plug connector which possesses at least four contact elements arranged in a housing which are intended for the transmission of high frequency signals, wherein in each case two contact elements form a contact element pair integrated into an insulating body, in that the insulating bodies are each surrounded by an additional shield.

The above and other objects, which will be apparent to those skilled in the art, are achieved in the present invention which is directed to a plug connector comprising a housing as well as at least four contact elements arranged within the housing for the transmission of high frequency signals, wherein in each case two contact elements form a contact element pair which is in each case integrated in an insulating body, wherein the insulating bodies are in each case surrounded by a shield, such that a contact part for the transmission of electrical supply energy arranged centrally within the housing is surrounded by the contact element pairs in a circular arrangement.

The shields form at least one contact lug for making contact with a complementary contact lug of a mating plug connector which is oriented at an angle to the plugging direction of the plug connector. At least some of the shield plates extend into an interstice formed between the insulating bodies and the contact part. In each case two shield plates and a section of the housing form a shield for an insulating body. Each shield plate forms at least one contact lug. The contact part is designed as a coaxial contact part with an inner contact part and an outer contact part surrounding the inner contact part. The insulating bodies in each case form, in cross section, a ring segment, wherein in each case a shield plate is arranged between two insulating bodies.

In a second aspect, the present invention is directed to a plug connector including a housing as well as at least four contact elements arranged within the housing for the transmission of high frequency signals, wherein in each case two contact elements form a contact element pair which is in each case integrated in an insulating body, wherein the insulating bodies are in each case surrounded by a shield, such that a contact part for the transmission of electrical supply energy arranged centrally within the housing is surrounded by the contact element pairs in a circular arrangement; and a cable, wherein the cable contains twisted wire pairs, wherein ends of the individual wire pairs are in each case connected with the contact elements of a contact element pair.

The wire pairs are shielded, and shielding of the wire pairs is connected with the shield of the plug connector.

In a third aspect, the present invention is directed to a plug connection including a first and a second plug connector, the plug connectors comprising a housing as well as at least four contact elements arranged within the housing for the transmission of high frequency signals, wherein in each case two contact elements form a contact element pair which is in each case integrated in an insulating body, wherein the insulating bodies are in each case surrounded by a shield, such that a contact part for the transmission of electrical supply energy arranged centrally within the housing is surrounded by the contact element pairs in a circular arrangement, wherein in a plugged-together state of the plug connectors at least the contact elements make contact.

The plug may include a coding which only permits the first and second plug connectors to be plugged together in one orientation.

The plug's housing, the contact elements, the shield, and the contact part of the first and of the second plug connector are so designed that, as the plug connectors are plugged together, the housings first engage with one another, then the contact parts make contact, then the contact elements make contact and then the contact lugs make contact.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
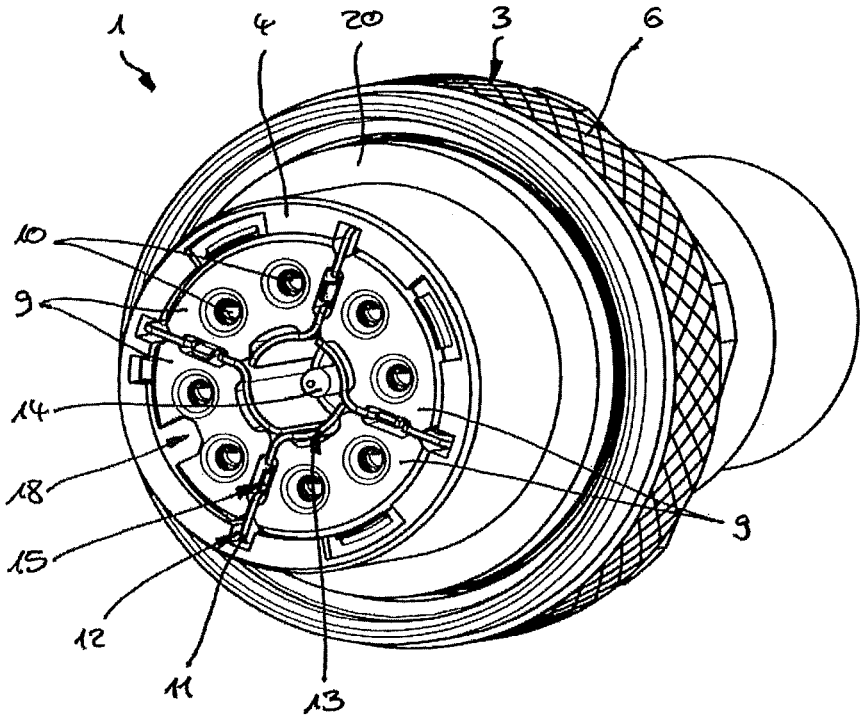
FIG. 1 shows a perspective view of an embodiment of a plug connector according to the invention in the form of a plug.
Figure 2:
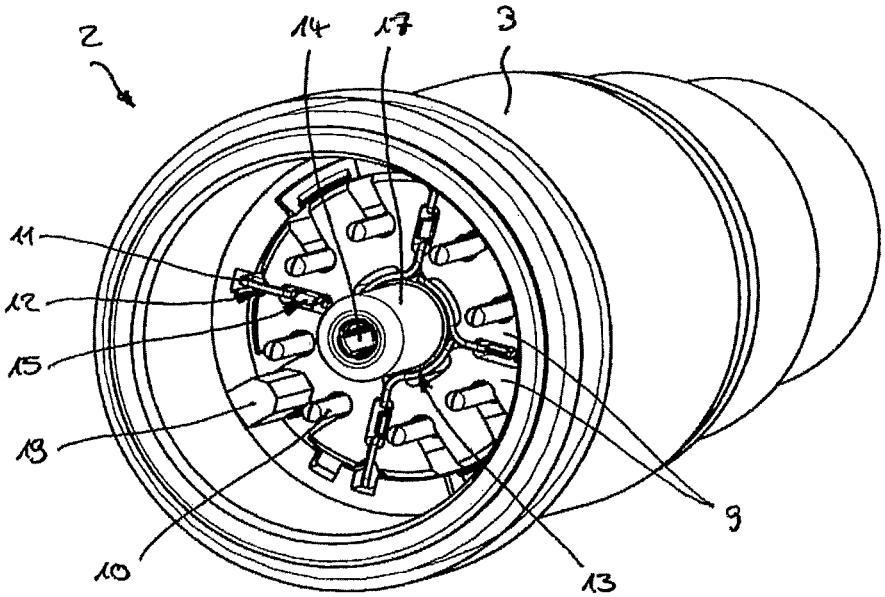
FIG. 2 shows a perspective view of a plug connector according to the invention in the form of a coupler, intended as a mating plug connector to the plug connector according to FIG. 1.
Figure 5:
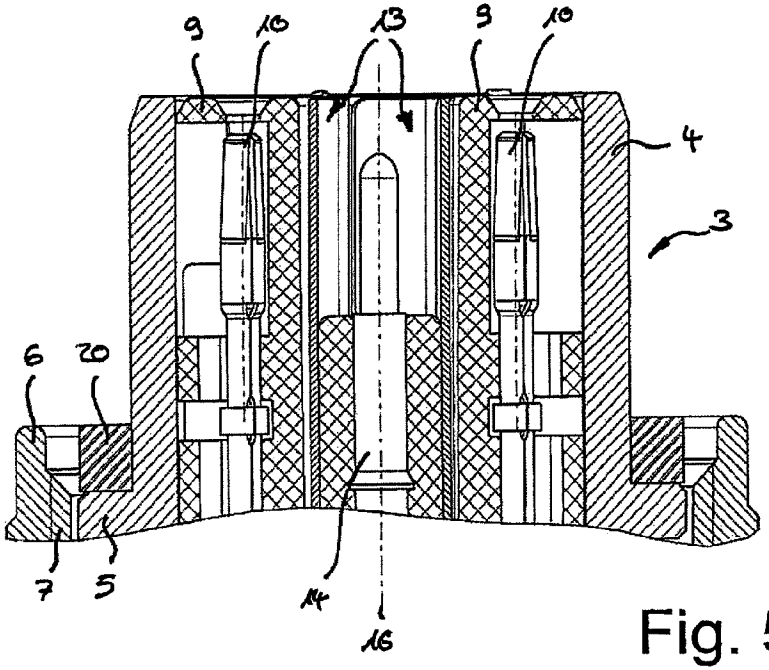
FIG. 5 shows a longitudinal section through the plug according to FIGS. 1, 3 and 4 along the sectional plane V-V in FIG. 3.
Figure 4:
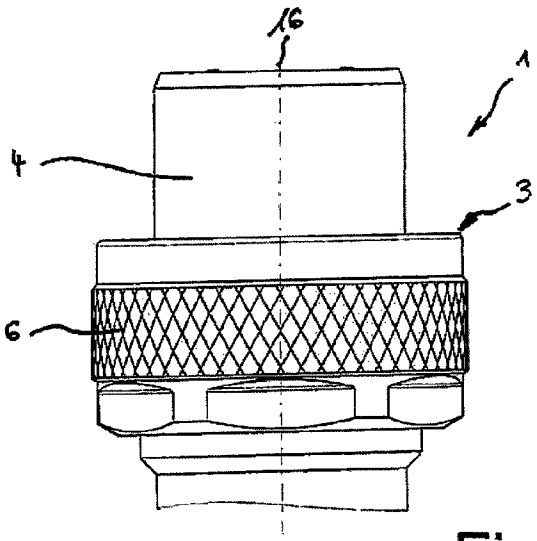
FIG. 4 shows a side view of the plug according to FIGS. 1 and 3.
Figure 3:
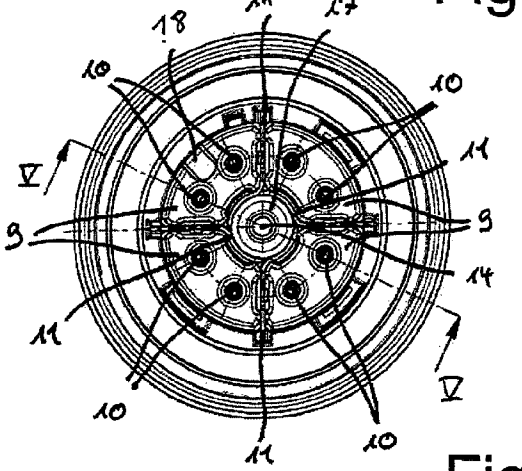
FIG. 3 shows a top view of the plug interface of the plug according to FIG. 1.
Figure 8:
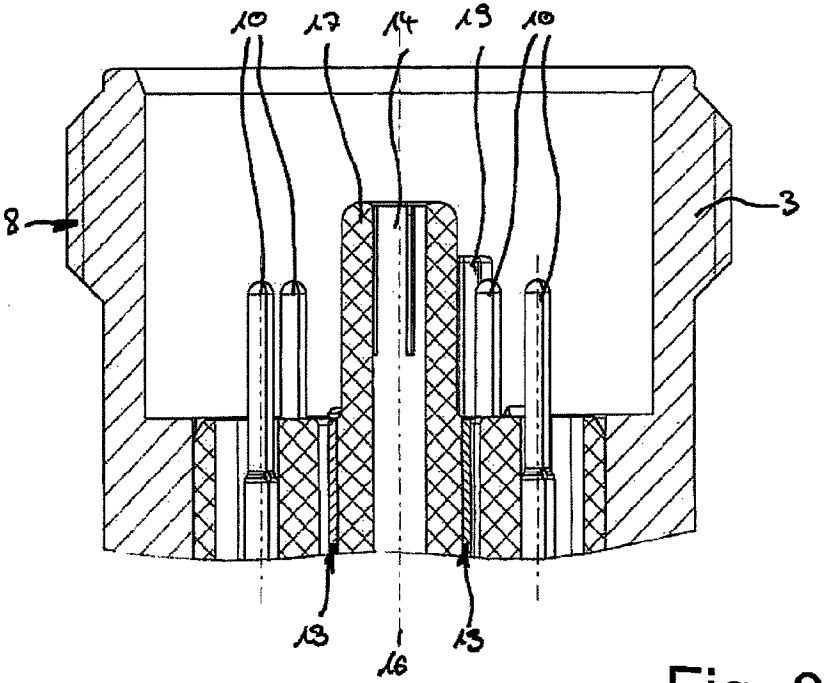
FIG. 8 shows a longitudinal section through the coupler according to FIGS. 2, 6 and 7 along the sectional plane VIII-VIII in FIG. 6.
Figure 7:
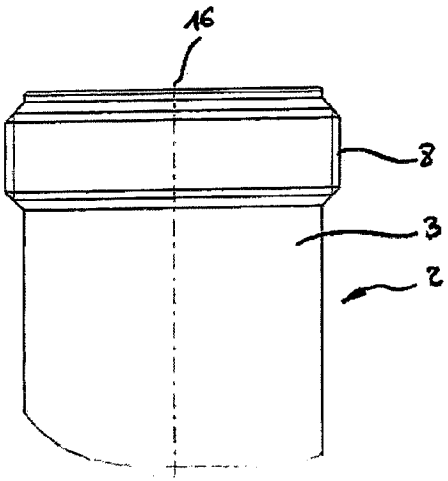
FIG. 7 shows a side view of the coupler according to FIGS. 2 and 6.
Figure 6:
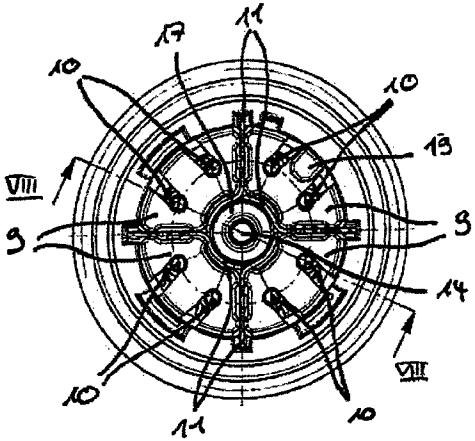
FIG. 6 shows a top view of the plug interface of the coupler according to FIG. 2.

In describing the preferred embodiment of the present invention, reference will be made herein to FIGS. 1-16 of the drawings in which like numerals refer to like features of the invention.

Starting out from this prior art, the invention was based on the problem of providing an improved plug connector which is, in particular, suitable for the transmission of high frequency signals with a data rate greater than 10 Gbits and a bandwidth greater than 500 MHz.

This problem is solved by a plug connector according to the claims. A unit consisting of a plug connector as well as a twisted-pair cable is the subject matter of the present invention as claimed. A plug connection consisting of two plug connectors according to the invention is a further subject matter of the present invention as claimed. Advantageous embodiments of the plug connector according to the invention, the unit according to the invention and the plug connection according to the invention are the subject matter of respective claims.

The invention is based on the idea of improving the transmission properties of a plug connector of the generic type which possesses at least four contact elements arranged in a housing which are intended for the transmission of high frequency signals, wherein in each case two contact elements form a contact element pair integrated into an insulating body, in that the insulating bodies are each surrounded by a shield. As a result of this additional shielding of the individual insulating bodies and the contact element pairs accommodated within the insulating bodies, undesirable crosstalk between the contact element pairs as well as with any central contact which may be present can be reduced. The additional shield can also serve to improve the shielding behavior with respect to external electromagnetic interference and with respect to adjacent cables.

A unit according to the invention comprises a plug connector according to the invention as well as a ("twisted-pair") cable which contains twisted wire pairs, the ends of which are in each case connected with the contact elements of a contact element pair.

A plug connection according to the invention comprises a first and a second plug connector, wherein in a plugged-together state (of the plug connection) at least the contact elements of the two plug connectors make contact.

In a preferred embodiment of the unit according to the invention, the wire pairs can be shielded—for example by means of an aluminum foil—whereby the shielding of the wire pairs is connected, in an electrically conductive manner, with the shielding of the plug connector. Such ("twisted-pair") cables are also referred to as "shielded twisted pair" cables or "foiled twisted-pair" cables.

In a further preferred embodiment, in the cable of the unit according to the invention—possibly in addition to a collective shield surrounding all wire pairs—the wire pairs are shielded in relation to each other, i.e., each of the wire pairs has its own shield (for example, again, an aluminum foil sheathing). Such ("twisted-pair") cables are also referred to as "screened shielded twisted pair" cables or "screened foiled twisted-pair" cables. Particularly preferably, the shields of the individual wire pairs are connected with the respective shields of the contact element pairs connected with these.

In order to realize an uninterrupted shielding of the individual contact element pairs of a plug connection according to the invention, it can preferably be the case that the two shields of the plug connectors of the plug connection each form at least one contact lug which is designed to make contact with the complementary contact lug of the mating plug connector. It is thereby preferably the case that the contact lug is oriented at an angle to the plugging movement direction (direction of the relative movement between the two plug connectors during the plugging-together operation). When contact is made between the two contact lugs, at least one of the contact lugs is (at least slightly) deflected in a lateral direction (relative to the plugging movement direction). On the one hand, this can provide a compensation of tolerances with regard to the relative position of the two contact lugs. In addition, the elastically pre-biased contact between the contact lugs ensures a good electrical contact.

In a further preferred embodiment of the plug connector according to the invention, this can further comprise a contact part which is intended for the transmission of electrical supply energy.

It can thereby preferably be the case that the contact part is designed as a coaxial contact part with an inner contact part and an outer contact part surrounding the inner contact part. This coaxial contact part can in this case preferably be connected with a coaxial conductor which forms part of the cable of a unit according to the invention. Alternatively to designing the contact part as a coaxial contact part, this can be designed as a simple solid conductor.

It can also be the case that the contact part is arranged centrally within the housing. It can also be the case that the contact element pairs or the insulating bodies accommodating these surround the contact part in an annular and in particular circular arrangement.

It can thereby be the case that the insulating bodies each form, in cross section, a ring segment, wherein a shield plate is in each case arranged between two insulating bodies.

Preferably, in this case each shield plate forms at least one contact lug which is intended to make contact with a complementary contact lug of a mating contact plug.

It can also preferably be the case that at least some, preferably all of the shield plates also extend into the interstice between the insulating bodies and the contact part. This makes possible a largely uninterrupted shielding of the individual insulating bodies, wherein, particularly preferably, in each case two shield plates and a section of the housing form an (all-round) shield for the individual insulating bodies.

In a preferred embodiment of the plug connection according to the invention, this can have a coding which only permits the first and second plug connectors to be plugged together in one orientation. For this purpose, the first plug connector of the plug connection according to the invention can for example possess a projection or a recess with which a complementary recess or projection of the mating plug connector engages, whereby said engagement is only possible in one relative (rotational) orientation of the two plug connectors.

In a further preferred embodiment of the plug connection according to the invention, the housing, the contact elements, the contact lugs of the shields and the contact parts of the first and second plug connector can be so designed that, when plugging together the plug connection, first the housings engage with one another, in particular in order to center the plug connectors relative to one another, then the contact parts make contact, then the contact elements make contact and then the contact lugs make contact.

Due to the separate shielding of the insulating bodies accommodating the contact elements, the plug connector according to the invention, the unit according to the invention and the plug connection according to the invention are advantageously suitable for the transmission of high frequency signals with a data rate which can also amount to >10 Gbits, and/or with a bandwidth which can also exceed 500 MHz.

FIGS. 1 and 3 to 5 show different views of a plug connector according to the invention in the form of a plug 1, shown in isolation, i.e., without the associated complementary mating plug connector. This mating plug connector in the form of a coupler 2 is shown in isolation, is depicted from different perspectives, in FIGS. 2 and 6 to 8. A plug connection formed by the two plug connectors is shown in FIGS. 9 to 16.

The plug connectors each comprise a housing 3 consisting of an electrically conductive material, in particular a metal (for example steel, copper, etc.), wherein the housing 3 of the plug 1 is formed of multiple parts. This comprises a substantially cylindrical inner housing 4 which forms on its outer side an annular shoulder 5 on which a fixing sleeve 6 can be supported on one side (see FIG. 16). The fixing sleeve 6 has on its inner side an inner thread 7 which is designed to screw together with an outer thread 8 of the housing 3 of the coupler 2. Among other things, this secures the plug connection formed by the two plug connectors against unintentional disconnection.

Within the housing 3, the plug connectors each contain four insulating bodies 9 (made, for example, of a ceramic material or a non-electrically-conductive plastic) which each have a cross section in the form of a ring segment. In the embodiment shown here, the insulating bodies 9 each form an integral part of a single-piece insulator of the plug 1 or coupler 2. Each of the insulating bodies 9 has two channels running parallel to each other as well as to the plugging direction of the two plug connectors, wherein a contact element 10 made of an electrically conductive material, in particular a metal (for example steel, copper, etc.) is arranged within each channel. The contact elements 10 are thereby arranged so as to be largely immovable in the plugging direction.

In the plug 1, the contact parts 10 are designed in the form of contact sockets. These serve to receive the contact elements 10 of the coupler 2 in the form of contact pins.

According to the invention, each of the insulating bodies 9 of the plug 1 as well as of the coupler 2 is provided with a separate shield formed by a section of the associated housing 3 together with (sections of) two shield plates 11. The shield plates 11 each make contact with the housing 3 and thus possess the same electrical potential as this. The individual shield plates 11 of the plug connectors each comprise a flat section 12 which extends radially between two adjacent insulating bodies 9 and a curved section 13 which shields the radially inner side of an associated insulating body 9.

The curved sections 13 of the four shield plates 11 form a cylinder barrel which shields the insulating bodies 9 in relation to a contact part 14 arranged centrally within the inner housing.

The flat sections 12 of the shield plates 11, which extend into the interstice formed between two adjacent insulating bodies 9, each possess a contact lug 15 curving obliquely in relation to the plugging direction (this corresponds to the longitudinal axes 16 of the two plug connectors). An electrically conductive connection between the shields of the plug 1 and the shields of the coupler 2 is established via the contact lugs 15 (see FIG. 15).

In the case of the plug 1, the contact part 14 arranged centrally within the housing 3 is designed as a contact pin which is arranged within a further insulating body 17 which insulates this (electrically) in relation to the curved sections 13 of the shield plates 11. In contrast, in the case of the coupler 2 the contact part 14 is designed in the form of a contact socket which is also arranged within an additional insulating body 17 which shields the contact socket in relation to the curved sections 13 of the shield plates 11.

One of the insulating bodies 9 of the plug 1 accommodating the contact elements 10 has a recess 18 into which a complementary projection 19 of an insulating body 9 of the coupler 2 can engage. This creates a coding which only allows the two plug connectors to be plugged together fully in one relative orientation. Insofar as different plug connections are provided in which the projection/recess pairings of the plug connectors differ in terms of the cross-sectional geometry (including cross sectional size) and/or in terms of the positioning within the housings of the plug connectors, the coding can in addition be so designed that only functionally matching plug connectors can be connected in order to form a plug connection.

As the plug 1 and the coupler 2 are plugged together, the plug-side end of the inner housing 4 of the plug 1 first engages in the central opening of the housing 3 of the coupler 2 (first stage of the plugging-together process). This realizes a centering of the two plug connectors relative to one another.

Figure 9:
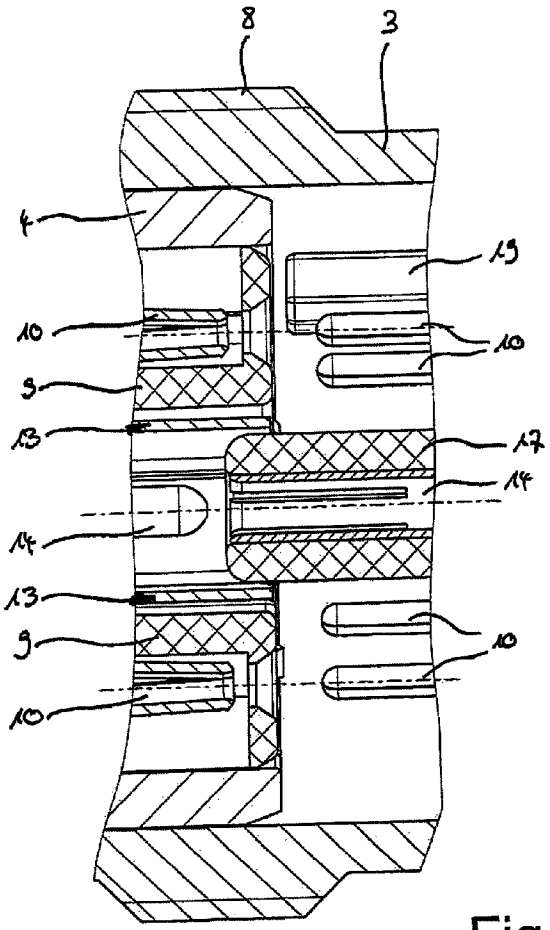
FIG. 9 shows a longitudinal section through a plug connection formed by the two plug connectors according to FIGS. 1 to 8 in the second stage of a five-stage plugging-together process.

On a continuation of the plugging movement, the plug-side end of the insulating body 17, which encloses the contact part 14 of the coupler 2 which is formed as a contact socket, engages in the cylinder barrel which is formed by the curved sections 13 of the four shield plates 11 (second stage of the plugging-together process; see FIG. 9). This too ensures a (further improved) centering of the two plug connectors relative to one another.

Figure 11:
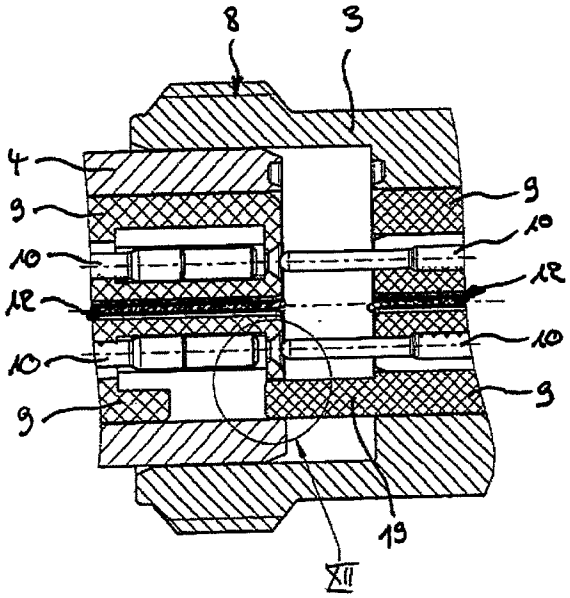
FIG. 11 shows a longitudinal section through the plug connection according to FIG. 10 along the sectional plane XI-XI in FIG. 10.
Figure 12:
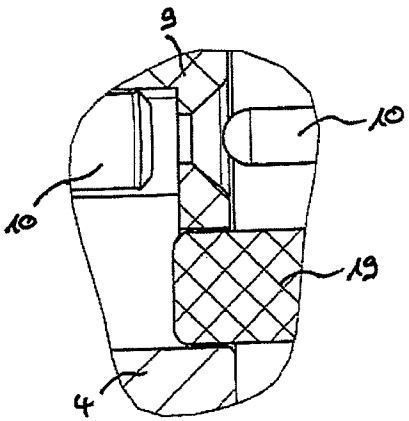
FIG. 12 shows an enlargement of the detail XII in FIG. 11.
Figure 10:
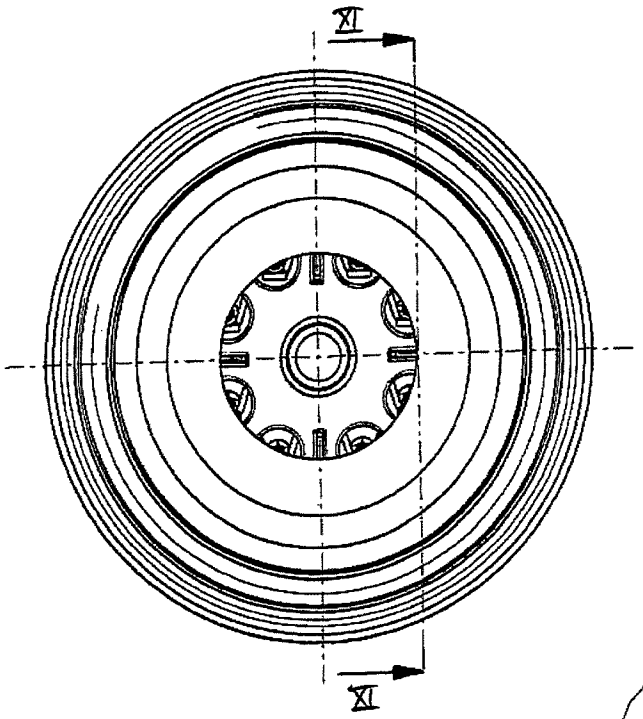
FIG. 10 shows a top view of a cable-side end of the plug connection according to FIG. 9 in a third stage of the plugging-together process.

On a further continuation of the plugging movement, the projection 19 of the coupler 2 then engages in the recess 18 of the plug 1 (third stage of the plugging-together process; see FIG. 11). However, this requires that the two plug connectors have the correct orientation relative to one another. Insofar as differently-coded plug connectors exist, this also requires that two functionally matching plug connectors—plug 1 and coupler 2—are connected together.

On a further continuation of the plugging movement, the contact parts 14 then make contact, i.e. the central contact pin of the plug 1 engages in the central contact socket of the coupler 2.

A further continuation of the plugging movement then leads to a contacting of the contact elements 10 of the two plug connectors in that the contact pins of the coupler 2 engage in the associated contact sockets of the plug 1 (fourth stage of the plugging-together process).

Figure 14:
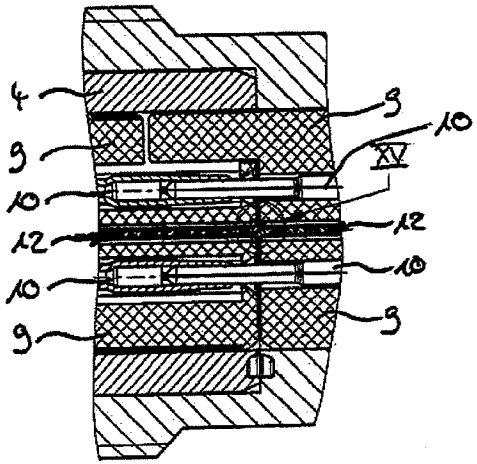
FIG. 14 shows a longitudinal section through the plug connection according to FIG. 13 along the sectional plane XIV-XIV in FIG. 13.
Figure 15:
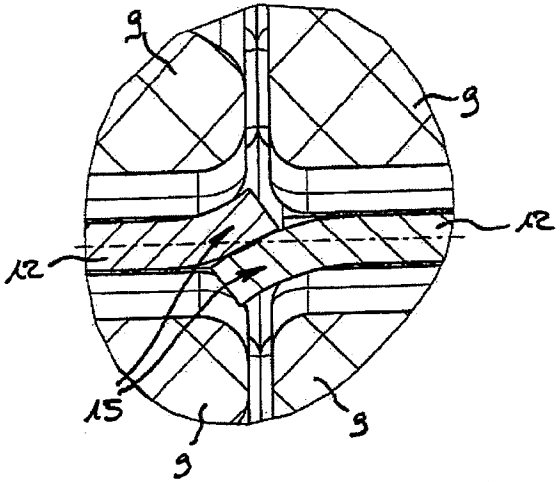
FIG. 15 shows an enlargement of the detail XV in FIG. 14.
Figure 13:
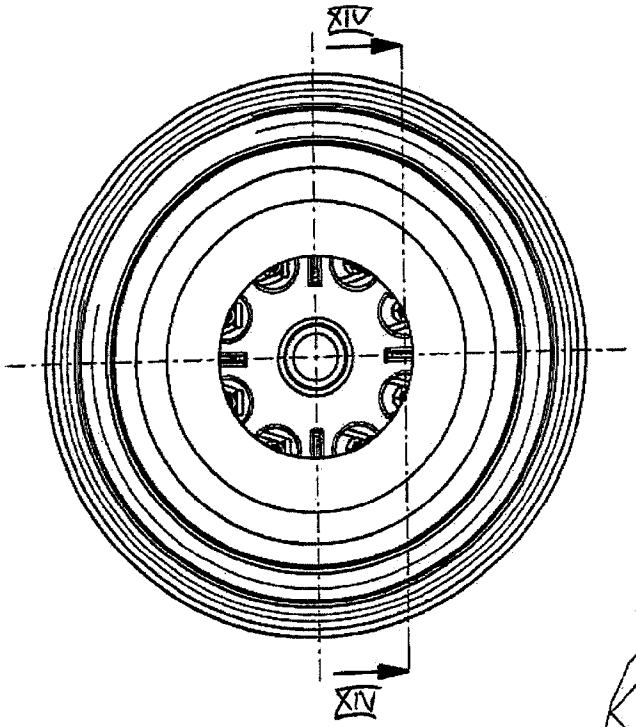
FIG. 13 shows a top view of the plug connection according to FIGS. 9 to 12 in a fifth stage of the plugging-together process.
Figure 16:
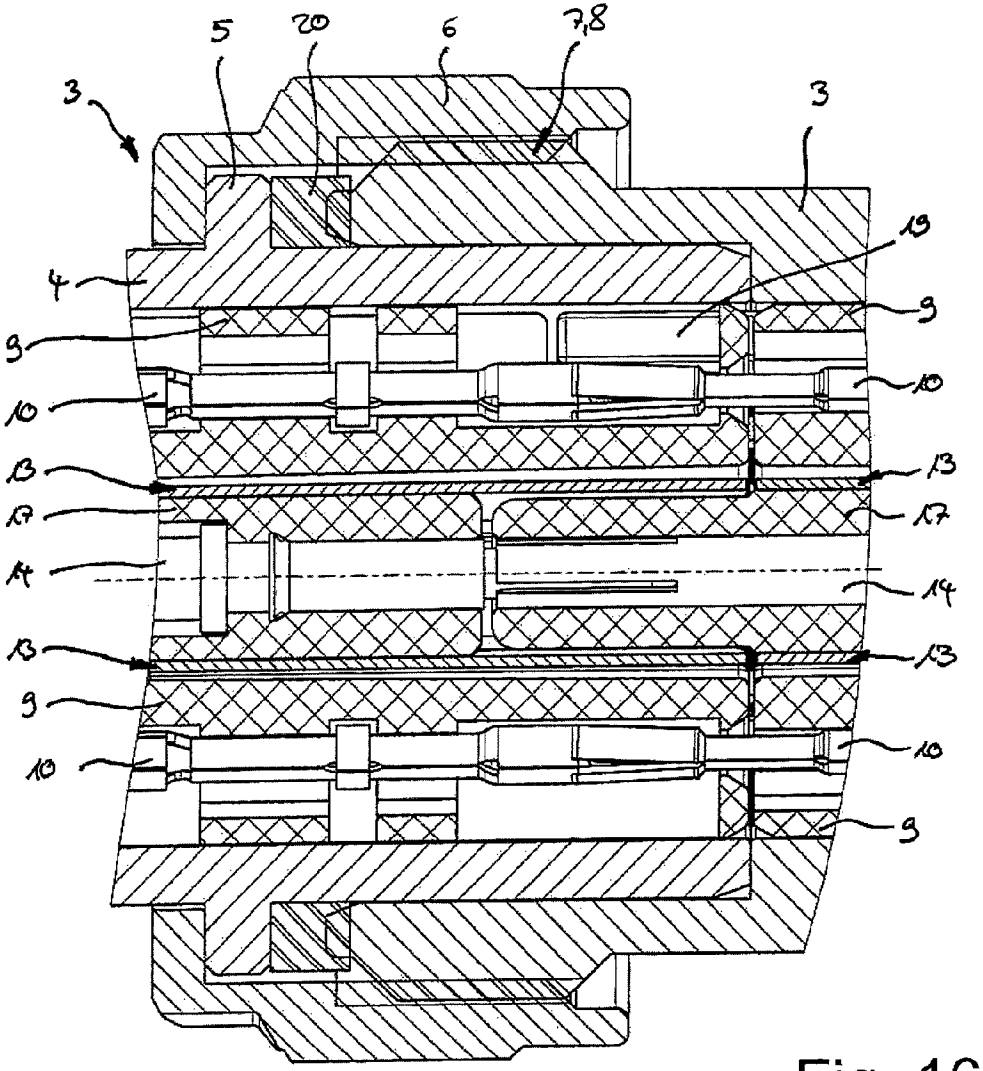
FIG. 16 shows a longitudinal section through the plug connection according to FIG. 13 along the sectional plane XVI-XVI in FIG. 13.

As a result of a further continuation of the plugging movement, the contact lugs 15 of the shield plates 11 of the two plug connectors are then brought into contact with one another (fifth stage of the plugging-together process; see FIGS. 14 and 15).

Insofar as the fixing sleeve 6 of the housing 3 of the plug 1 is then screwed together with the housing 3 of the coupler 2, the plug connection is also additionally secured against unintentional disconnection. At the same time a sealing ring 20 clamped between the housings 3 of the plug connectors (specifically, between the annular shoulder 5 of the housing 3 of the plug 1 and the plug-side end of the housing 3 of the coupler 2) seals off the functional elements arranged within the housing 3 from the environment.

In an alternative embodiment of the plug connectors according to the invention (plug and/or coupler), not shown in the drawings, the four shield plates 11 can be designed as single-part shield bodies, which can preferably be manufactured economically as a cast component and in particular as a zinc die-cast component.

Alternatively, since an integration of contact lugs 15 in such a cast component can only be implemented with difficulty, the shield bodies of plug and coupler can make contact laterally, in that, for example, a section of the flat parts 12 of the shield bodies of plug and coupler extending between two adjacent insulating bodies 9 overlap. Naturally, alternatively or additionally, the cylindrical parts of the shield bodies enclosing the central contact part 14 can overlap, for example in that these have correspondingly differing diameters.

Otherwise, the plug connectors according to this alternative embodiment can be designed as in the embodiment shown and described in the drawings.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug connector comprising a housing as well as at least four contact elements arranged within the housing for the transmission of high frequency signals, wherein in each case two contact elements form a contact element pair, each contact element pair is integrated in an insulating body, wherein the insulating bodies are in each case surrounded by a shield, such that a contact part for the transmission of electrical supply energy arranged centrally within the housing is surrounded by the contact element pairs in a circular arrangement.

2. The plug connector of claim 1, wherein the shields form at least one contact lug for making contact with a complementary contact lug of a mating plug connector which is oriented at an angle to the plugging direction of the plug connector.

3. The plug connector of claim 1, wherein the contact part is designed as a coaxial contact part with an inner contact part and an outer contact part surrounding the inner contact part.

4. The plug connector of claim 1 wherein said connector is designed for use in transmission of high frequency signals with a data rate >10 Gbits and/or a bandwidth >500 MHz.

5. The plug connector of claim 1, wherein the insulating bodies in each case form, in cross section, a ring segment, wherein in each case a shield plate is arranged between two insulating bodies.

6. The plug connector of claim 5, wherein, in each case two shield plates and a section of the housing form a shield for an insulating body.

7. The plug connector of claim 2, wherein the contact part is designed as a coaxial contact part with an inner contact part and an outer contact part surrounding the inner contact part.

8. The plug connector of claim 7, wherein the insulating bodies in each case form, in cross section, a ring segment, wherein in each case a shield plate is arranged between two insulating bodies.

9. The plug connector of claim 8, wherein each shield plate forms at least one contact lug.

10. The plug connector of claim 5, wherein each shield plate forms at least one contact lug.

11. The plug connector of claim 10, wherein at least some of the shield plates extend into an interstice formed between the insulating bodies and the contact part.

12. The plug connector of claim 10, wherein, in each case two shield plates and a section of the housing form a shield for an insulating body.

13. The plug connector of claim 5, wherein at least some of the shield plates extend into an interstice formed between the insulating bodies and the contact part.

14. The plug connector of claim 13, wherein, in each case two shield plates and a section of the housing form a shield for an insulating body.

15. A unit comprising:

a plug connector including a housing as well as at least four contact elements arranged within the housing for the transmission of high frequency signals, wherein in each case two contact elements form a contact element pair, each contact element pair is integrated in an insulating body, wherein the insulating bodies are in each case surrounded by a shield, such that a contact part for the transmission of electrical supply energy arranged centrally within the housing is surrounded by the contact element pairs in a circular arrangement; and a cable, wherein the cable contains twisted wire pairs, wherein ends of the individual wire pairs are in each case connected with the contact elements of a contact element pair.

16. The unit of claim 15, wherein the wire pairs are shielded, and shielding of the wire pairs is connected with the shield of the plug connector.

17. The unit of claim 15 wherein said plug connector is designed for use in transmission of high frequency signals with a data rate >10 Gbits and/or a bandwidth >500 MHz.

18. A plug connection including a first and a second plug connector, said plug connectors comprising a housing as well as at least four contact elements arranged within the housing for the transmission of high frequency signals, wherein in each case two contact elements fouls a contact element pair, each contact element pair is integrated in an insulating body, wherein the insulating bodies are in each case surrounded by a shield, such that a contact part for the transmission of electrical supply energy arranged centrally within the housing is surrounded by the contact element pairs in a circular arrangement, wherein in a plugged-together state of the plug connectors at least the contact elements make contact.

19. The plug connection of claim 18, wherein the housing, the contact elements, the shield and the contact part of the first and of the second plug connector are so designed that, as the plug connectors are plugged together, the housings first engage with one another, then the contact parts make contact, then the contact elements make contact and then contact lugs make contact.

20. The plug connection of claim 18 wherein said first and second plug connectors are designed for use in transmission of high frequency signals with a data rate >10 Gbits and/or a bandwidth >500 MHz.

21. The plug connection of claim 18, including a coding which only permits the first and second plug connectors to be plugged together in one orientation.

22. The plug connection of claim 21, wherein the housing, the contact elements, the shield and the contact part of the first and of the second plug connector are so designed that, as the plug connectors are plugged together, the housings first engage with one another, then the contact parts make contact, then the contact elements make contact and then the contact lugs make contact.

* * * * *